US005398614A

United States Patent [19]

Koenig

[11] Patent Number: 5,398,614

[45] Date of Patent: Mar. 21, 1995

[54] RAM AIR INFLATED DECELERATOR DEPLOYMENT FLAPS

[75] Inventor: Walter Koenig, Sparta, N.J.

[73] Assignee: The United States of America as represented by the Secretary of the Army, Washington, D.C.

[21] Appl. No.: 265,461

[22] Filed: Jun. 10, 1994

[51] Int. Cl.[6] ..... F42B 10/56

[52] U.S. Cl. ..... 102/387; 244/147

[58] Field of Search ..... 102/386, 387; 244/113, 244/142, 147

[56] References Cited

U.S. PATENT DOCUMENTS

| | | | |
|---|---|---|---|
| 3,145,956 | 8/1964 | Widdows | 244/147 |
| 5,188,315 | 2/1993 | Foitzik et al. | 244/152 |
| 5,233,126 | 8/1993 | Vogt et al. | 102/386 |

*Primary Examiner*—Charles T. Jordan
*Assistant Examiner*—Theresa M. Wesson
*Attorney, Agent, or Firm*—Anthony T. Lane; Edward Goldberg; Michael C. Sachs

[57] ABSTRACT

A cover or apron interposed between a ballute and the aft cover of a submunition for delaying deployment of the ballute and preventing the ballute from contacting the aft cover during deployment.

7 Claims, 3 Drawing Sheets

RAM AIR INFLATED DECELERATOR DEPLOYMENT FLAPS

The invention described herein may be manufactured, used and licensed by or for the Government for Government purposes without the payment to me of any royalties thereon.

FIELD OF THE INVENTION

This invention relates to a device for delaying the deployment of a ballute from a submunition that has been released from a carrier projectile.

BACKGROUND OF THE INVENTION

A sense and destroy armor (SADARM) munition includes, inter alia a carrier projectile (not shown), at least one submunition 15, as shown in FIG. 1, having a first stage decelerator, also known as a ballute 16 (FIGS. 3 and 4), which is tucked into the aft end or storage module 18 (FIG. 3) of submunition 15, a deployment cord 20 (FIGS. 2, 3, 5 and 6) having a first end 21 detachably connected to ballute 16 and a second end thereof integrally fixed to an aft cover 22 (FIGS. 1–3), for instance, by a screw (not shown). Aft cover 22 is held to submunition 15 by a plurality of clips 24 (FIGS. 2 and 9) which are, in turn, held in place by a band 40 (FIG. 2). The submunition also includes a micro-processor, other timing devices, explosives, a fuze, and radar and infra-red sensors (not shown) for locating, locking onto and destroying targets.

In operation, the submunition is ejected from the carrier projectile and after a time delay band 40 on the submunition, holding clips 24 in position, is blown off by a small charge. The charge in combination with centrifugal forces is sufficient to dislodge clips 24 releasing aft cover 22 from aft end 18 of submunition 15. Centrifugal forces, in combination with the pull of deployment cord 20, pull ballute 16 from its storage cavity. Aerodynamic forces move the aft cover away from the deploying ballute and the first end 21 of the deployment cord ruptures so that the aft cover 22 falls independently of the submunition 15. The function of the ballute 16 is to reduce the spin rate and forward velocity of the SADARM submunition after it is ejected from the carrier projectile.

During test firings and post-inspection of such submunitions, technicians have found the ballute to be damaged. It is speculated that damage to the ballute results from contact between the aft cover and the ballute during ballute deployment. Damage to the ballute results in mission failure and the loss of a $5,000.00 submunition.

In order to solve this problem, three changes have been made. First, all of the exposed edges and cut-outs of the aft cover have been smoothed. In making this change it was believed that if ballute/aft cover contact occurred, the contact would be less damaging. Unfortunately, for some unexplained reason, such changes resulted in a greater rate of failure. In a second change, the rupture cord attachment screw was moved from an outboard location on the aft cover to the inside center of the cover; and third, different ballute packing techniques were tried. However, the loss of munitions still occurs at a remarkable rate because of damage to the ballute.

Accordingly, it is an object of the present invention to prevent loss of a submunition because of damage to the ballute on deployment.

Another object of the invention is to delay deployment of the ballute until after the aft cover is a safe and uncontactable distance from the ballute.

Other objects will become apparent by reference to the drawings and from the detailed description of the invention.

SUMMARY OF THE INVENTION

The present invention relates to a cover or apron composed of foldable flaps that are interposed between a ballute and the aft cover of a submunition for delaying deployment of the ballute and for preventing the ballute from contacting the aft cover during deployment. More particularly, the invention relates to a submunition including a ballute deployable therefrom, an aft cover for covering the aft end of the submunition, a deployment cord, a first end of said deployment cord integrally secured to the aft cover, a second end rupturably connected to the ballute, and an apron interposed between the ballute and the aft cover for retaining the ballute within the submunition for a time sufficient for the aft cover to clear the aft end of the submunition during deployment of the ballute, thereby preventing contact between the ballute and the aft cover.

DETAILED DESCRIPTION OF THE INVENTION

Figure 3:
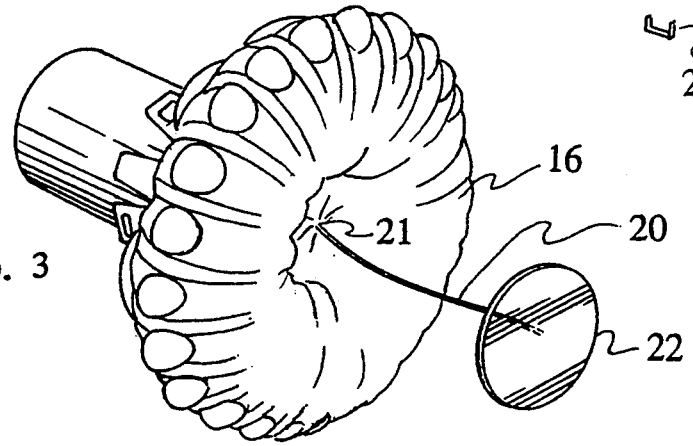
FIG. 3 is a perspective diagram of the submunition of FIG. 2 showing a deployed ballute, an aft cover released therefrom and rupture of the deployment cord.
Figure 4:
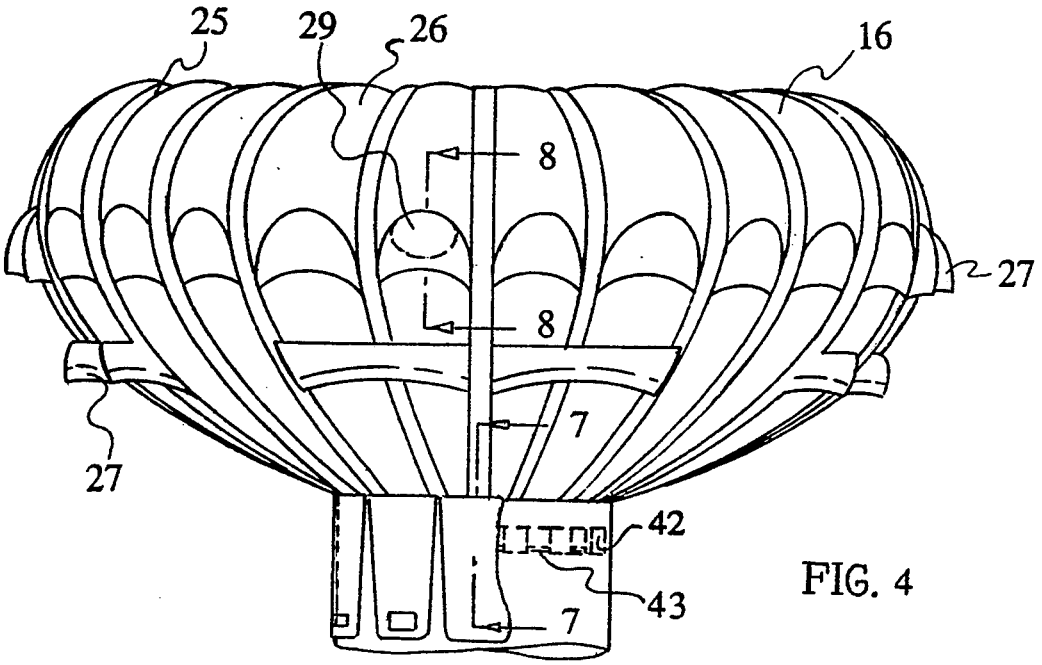
FIG. 4 is a plan view of a deployed ballute.

A ballute is a parachute-type device for slowing both the forward and spin velocity of a munition. The ballute may take the form of various shapes and designs. For illustration, the deployed ballute 16 (as shown in FIGS. 3 and 4), in cross section, resembles a deployed automotive air bag, except that the front or top surface of ballute 16 is a depressed or recessed surface. Other differences are appreciated from a full review of the specification.

Figure 7:
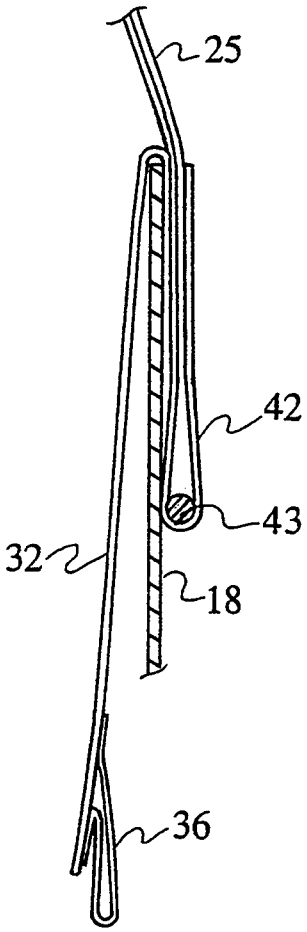
FIG. 7 shows the detail taken along line 7—7 of FIG. 4.
Figure 8:
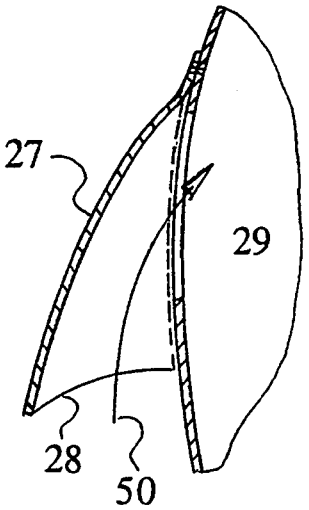
FIG. 8 shows the detail of an air inlet and is the view taken along line 8—8 of FIG. 4.

Ballute 16 is composed of a plurality of radially spaced tapes or strips 25 (FIGS. 4 and 7) emanating from a common structure and terminating as separate looped ends 42 (FIG. 7). Circumferentially extending panels (or gores) 26 (FIG. 4) are arranged between the spaced radial tapes 25, the edges of which are sewn to the tapes with reinforced KEVLAR TM stitching to form a curvilinear solid structure. Positioned circumferentially around ballute 16 and sewn on panels 26 are a plurality of burble fences (FIGS. 3, 4 and 8), pockets, or covers 27 terminating in scalloped ends 28 for catching air when the ballute is deployed.

Air inlets 27 hide holes 29 (FIGS. 4 and 8) in the ballute. These holes direct air, caught by inlets 27, as shown by arrow 50 (FIG. 8), into the ballute to inflate the ballute. A deployed ballute slows the spin rate and the forward velocity of a munition.

Figure 10:
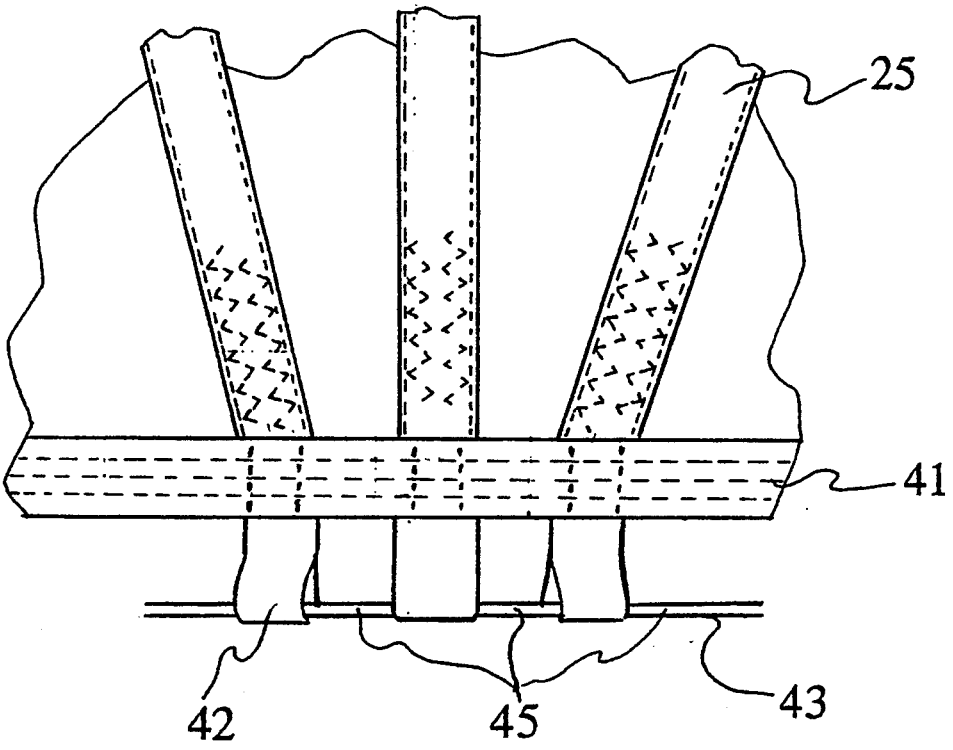
FIG. 10 shows the looped ends of radial tapes, a reinforcing fabric member and a wire seated in the looped ends of the radial tapes.

A fabric reinforcing tape 41 (FIG. 10) is sewn circumferentially just above the looped ends 42 of the radial tapes 25. A wire ring 43 (FIGS. 4 and 7) passes through or is seated within the looped ends 42, and the exposed surfaces 45 (FIG. 10) of the wire are fastened to the circumferential inside surface of the aft end of the submunition.

Figure 1:
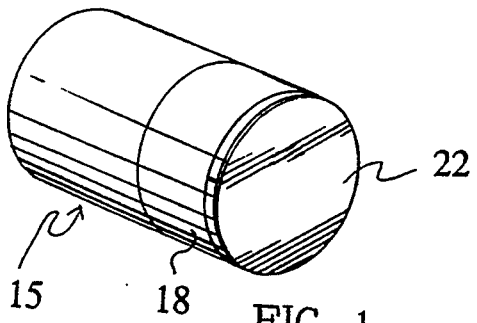
FIG. 1 shows a submunition free from its carrier projectile, and prior to deployment of a ballute.
Figure 2:
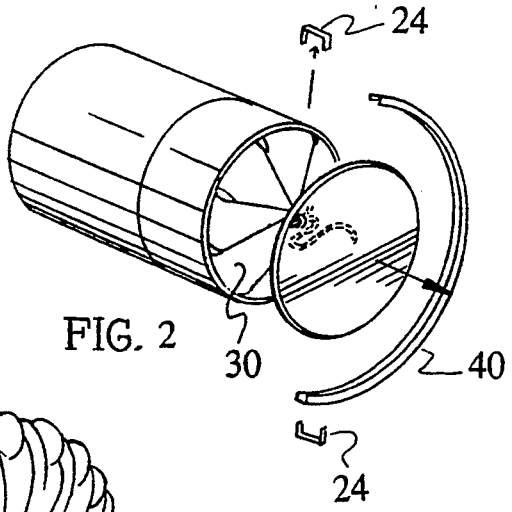
FIG. 2 shows the beginning stages of deployment of a ballute.
Figure 5:
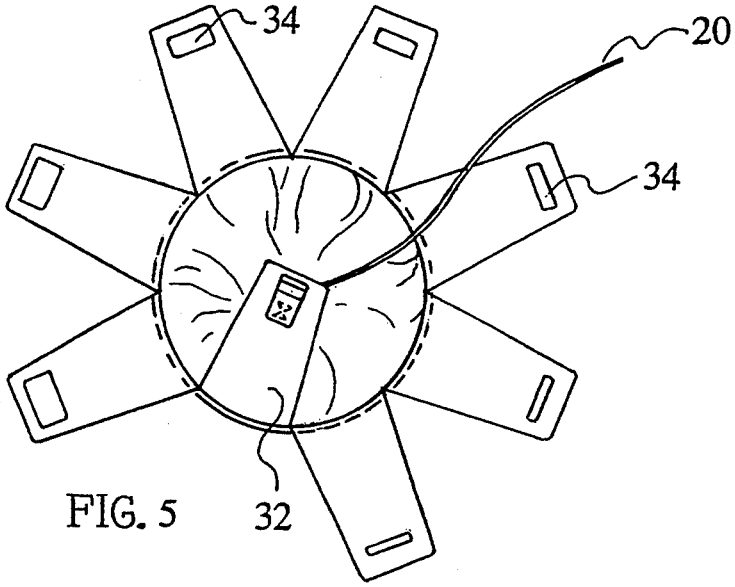
FIG. 5 shows a substantially unfolded apron of the invention composed of a plurality of cover flaps; a first flap is in its folded position.

As discussed above, ballute 16, prior to deployment, is folded and sits within the aft end 18 or decelerator module end of a submunition as shown in FIG. 5. The present invention includes a cover or apron 30 (FIG. 2) substantially interposed between ballute 16 and aft cover 22 preventing both premature deployment of the ballute and aft cover/ballute-contact which would otherwise subject the ballute to an increased probability of damage and mission failure.

Apron 30 of the invention may be composed of four or more generally equally dimensioned rectangular-shaped and tapering flaps 32. Eight such flaps are shown in FIG. 5. A flap is generally flat and can be made from woven or non-woven natural or synthetic fibers. Flaps 32 may be made from a single piece of nylon fabric or may be a two-piece fabric construction wherein each piece or part represents one face of the flap. The two faces are mirror images of one another. In a two-piece type construction, the inside or interior face i.e., the piece facing folded ballute 16 inside the aft end of the submunition may be a woven teflon fabric, and the exterior face of a flap is preferably a woven nylon fabric. The two fabric pieces are sewn to one another creating a reinforced flap. The one-piece construction may be manufactured from synthetic or natural fibers or a blend thereof. Of course, an apron may be composed of a greater number of flaps and the flaps may be of any other geometric shape, e.g., triangular.

Figure 6:
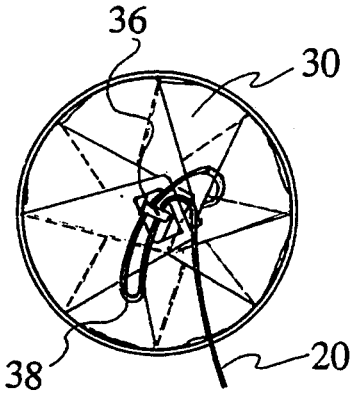
FIG. 6 shows the flaps of FIG. 5 folded; the flaps are folded in sequence in the clockwise direction.

In addition, flaps 32 are thin and the lengths and widths thereof are of such dimensions that when in a folded position each flap is overlapped or overlaps at least one side surface of an adjacent flap (see FIG. 6), and the top edges or the apex of a flap, as shown in FIG. 6, overlap or is overlapped by the apex or top surface of a another flap.

The base of each flap 32 may be interposed between and sewn or fastened to the looped ends 42 of radial tapes 25 of ballute 16 and the fabric reinforcement band 41, and then the assembly is attached to the inside circumferential surface of the aft end of the submunition, as discussed above. Of course, each of the plurality of flaps 32 is sewn to a different portion of the fabric band or to different radial tapes, preferably just above the looped ends of the radial tapes.

All but one of the flaps 32 have buttonhole type slits 34 (FIG. 5) positioned on or near the apex thereof. All of the buttonholes but one are large to aid in assembly, the last one to be folded has a small buttonhole for closure. The first flap, or the flap shown in the folded position superposing the ballute 16 in FIG. 5 has, instead of a slit, either a generally rigid or a flexible closure loop member 36 (FIGS. 6 and 7) which is fastened below the apex thereof on the outside face of the flap as shown in FIG. 5.

The ballute 16 having deployment cord 20 attached thereto is covered by apron 30 of the invention by first folding the flap having the closure loop member 36 (FIGS. 5 and 7) thereon over a first portion of the ballute. Such folding exposes the closure member 36 to buttonholes 34 on the remaining flaps 32 as shown in FIG. 5. The remaining flaps are folded successively in the clockwise direction so that the ballute is entirely covered as shown in FIG. 6 and so that the closure member 36 is received within buttonholes 34. Additionally, the flaps are folded so that deployment cord 20 extends through the folded flaps as shown in FIG. 6. Deployment cord 20 may then be folded back on itself creating a loop 38 which is slipped under the closure member, as shown in FIG. 6. Alternatively, instead of forming a loop, the cord 20 may be provided with a short stiff T-shaped extension (not shown) that can be slipped through closure member 36.

Figure 9:
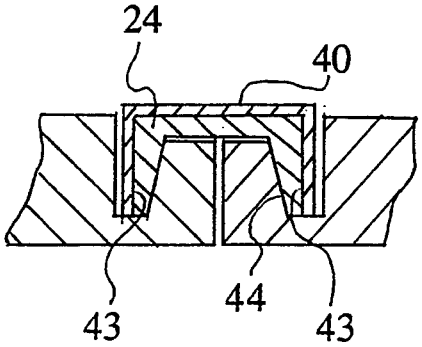
FIG. 9 shows attachment of submunition module and end plate of FIG. 1 by band and clamp means.

To complete the assembly of submunition 15, the second end of the cord 20 is integrally fastened to the center of the inside surface of aft cover 22. Aft cover 22 which has a diameter equal to the diameter of the aft end 18 or module of the submunition housing ballute 16 abuts the module. These two structures are secured to each other by at least three aluminum clamps or clips 24 having prongs 46 (FIG. 9). The clips straddle the aft cover and the module in recessed structures that are formed by aligning recessed portions of aft cover 22 and the module 18. Each recessed portion has a chin 44 therein for retaining the prongs of the clamps. A circumferential band 40 is positioned over the clamps to prevent premature module and aft cover separation.

The submunition is thereafter loaded into a carrier projectile.

The sequence of steps of ballute deployment used in association with the apron of the present invention is similar to the prior art steps except the apron 30 delays deployment of the ballute 16. In operation, the submunition is ejected from the carrier projectile; after a time delay, the band holding clamps 24 in position is blocked off by a small charge, which in combination with centrifugal forces is sufficient to dislodge clamps 24, releasing aft cover 22 from aft end or module 18 of submunition 15. The aft cover and the ballute-containing module then begin to separate. During separation of the aft cover from the submunition deployment cord 20 uncoils or unfolds; as it does so apron 30 prevents ballute 16 from deploying, allowing the aft cover to distance itself from the aft end of the submunition. As aft cover 22 moves further away from module 18, by virtue of aerodynamic forces, deployment cord 20 becomes taut and loop 38 pulls on closure member 36 allowing all of flaps 32 to unfold and, somewhat simultaneously, the ballute is pulled from the interior of the submunition. When deployment cord 20 is fully taut, such that the tension on the deployment cord reaches approximately eighty pounds, which is the rupture point of end 21, deployment cord 20 ruptures (FIG. 3) separating the aft cover from the submunition.

By interposing deployment flaps between the aft cover and the ballute as shown and described the ballute is prevented from prematurely deploying and striking the aft cover preventing ballute damage.

It should be apparent that many modifications may be made to the invention without departing from the spirit and scope of the invention. Therefore, the drawings and the description set forth herein are only set forth for illustration and direction; the invention is only limited in scope by the appended claims.

What is claimed is:

1. In a submunition including a ballute deployable from an aft end thereof and a removable aft cover covering the aft end of the submunition, the improvement which comprises: an apron interposed between the ballute and the aft cover for retaining the ballute within the submunition for a time sufficient for the aft cover to clear the aft end of the submunition during deployment of the ballute, thereby preventing contact between the ballute and the aft cover.

2. The submunition according to claim 1 wherein said apron comprises a plurality of foldable flaps, said flaps, in a foldable position, cover the ballute prior to deployment thereof.

3. The submunition according to claim 1 wherein said apron is composed of a plurality of foldable flaps, wherein a base of at least one flap is secured to at least a portion of the ballute.

4. The submunition according to claim 3 wherein an unsecured end of said at least one flap superposes a portion of the ballute.

5. A submunition including a ballute deployable from the aft end of the submunition and an apron superposing the ballute, said ballute comprising a plurality of radially spaced tapes, at least a first and second tape of said plurality of tapes terminates in a looped end, and a portion of said apron is fastened to said first and second tapes.

6. The submunition of claim 5 wherein said portion of said apron is fastened to said first and second tapes above the looped end of said tapes.

7. The submunition of claim 6 wherein the portion of said apron fastened above the looped ends of the radial tapes is interposed between a fabric reinforcement band and said tapes.

* * * * *